US010006227B1

(12) United States Patent
Szebeni

(10) Patent No.: US 10,006,227 B1
(45) Date of Patent: Jun. 26, 2018

(54) CABLE LOCKING DEVICE

(71) Applicant: Larry Lorant Szebeni, Stamford, CT (US)

(72) Inventor: Larry Lorant Szebeni, Stamford, CT (US)

( * ) Notice: Subject to any disclaimer, the term of this patent is extended or adjusted under 35 U.S.C. 154(b) by 0 days. days.

(21) Appl. No.: 15/821,542

(22) Filed: Nov. 22, 2017

(51) Int. Cl.
*E05B 67/38* (2006.01)
*E05B 67/00* (2006.01)
*E05B 73/00* (2006.01)

(52) U.S. Cl.
CPC ..... *E05B 67/383* (2013.01); *E05B 67/003* (2013.01); *E05B 73/0005* (2013.01); *E05B 2067/386* (2013.01)

(58) Field of Classification Search
CPC .. E05B 67/383; E05B 67/003; E05B 73/0005; E05B 2067/386
USPC ..... 70/52–56, 232
See application file for complete search history.

(56) References Cited

U.S. PATENT DOCUMENTS 3,559,429 A 2/1971 Hermann
3,765,197 A 10/1973 Foote
4,763,496 A * 8/1988 Evans ..... E05B 67/24 70/368
4,773,239 A * 9/1988 Lowe ..... A63C 11/005 280/11.204
5,447,045 A 9/1995 Cheng
5,502,989 A 4/1996 Murray, Jr. et al.
5,794,463 A 8/1998 McDaid
5,916,283 A * 6/1999 Steinbach ..... A44B 15/00 70/38 A
6,439,008 B1 * 8/2002 Keil ..... B60D 1/60 70/54
6,578,393 B2 * 6/2003 Yarborought ..... E05B 67/38 70/52
6,705,134 B2 * 3/2004 Miranda ..... E05B 67/02 70/417
2008/0209957 A1 * 9/2008 Araujo ..... E05B 35/105 70/21
2009/0301145 A1 * 12/2009 Valerio ..... E05B 35/105 70/21

* cited by examiner

*Primary Examiner* — Suzanne Lale Dino Barrett
(74) *Attorney, Agent, or Firm* — CIONCA IP Law P.C.; Martin Cionca

(57) ABSTRACT

A locking device for adding security to an item locked by a lock having a cable, the locking device having: a housing configured to receive the lock by having a shape similar to the lock, the housing comprising an open top; a floor having mounting holes configured for receiving means for securing the housing to a surface; a first side wall having a first top wall end; and a second side wall; and means for receiving a first cable end and thus receiving the lock into the housing; means for restricting a movement of the first cable end out of the housing when means for unlocking and locking a second cable end into a first locking portion of the lock is in a locked state; and a first circular opening inaccessible from the first top wall end, and aligned with the first locking portion when the housing receives the lock.

13 Claims, 6 Drawing Sheets

CABLE LOCKING DEVICE

BACKGROUND OF INVENTION

1. Field of the Invention

The present device relates generally to locking devices, particularly for firearms, storage cases or other movable property, locked with a keyed or combination cable lock, and more specifically to devices that lock with a cable.

2. Description of the Related Art

Owners of firearms or any other similar sensitive or valuable items may need to securely lock their possessions, and have the capability to quickly unlock the item when the item is needed. Additionally, a user owning a firearm or any other valuable item may need to lock their valuables in an environment that is secure against tampering or any unauthorized removal. Therefore, there is a need for a secure and tamper-proof locking device that may also be quickly unlocked.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a locking device for adding security to an item locked by a lock having a cable, is provided, wherein the cable has a first cable end associated with the lock at a first cable attachment point of the lock, and wherein the lock has means for unlocking and locking a second cable end at a first locking portion of the lock, the locking device comprising: a housing configured to receive the lock by having a rectangular shape substantially similar to the lock, the housing comprising: an open top; a floor having a plurality of mounting holes, each one of the plurality of mounting holes configured for receiving a means for securing the housing to a surface; a first side wall having a first top wall end, and a plurality of openings; and a second side wall opposite of the first side wall; the first side wall and the second side wall extending perpendicularly from the floor; the plurality of openings being configured to receive the first cable end and the second cable end when the lock is received by the housing by having: a first L-shaped opening, wherein a vertical portion of the first L-shaped opening is a cutout on the first top wall end, and a horizontal portion of the first L-shaped opening, the horizontal portion being inaccessible from the first top wall end such that a vertical movement of the first cable end is restricted when the horizontal portion receives the first cable end; and a first circular opening inaccessible from the first top wall end, and aligned with the locking portion when the housing receives the lock; wherein the housing receives the lock by receiving the first cable end into the vertical portion of the first L-shaped opening and then further into the horizontal portion of the first L-shaped opening, such that the first cable attachment point is aligned with the horizontal portion and the lock rests on the floor, and thus restricts access to the plurality of mounting holes; and such that security to the item is added when the cable is threaded through the item and the second cable end is received by the first lock opening through the first circular opening and the second cable end is locked into the lock, thus preventing a removal of the lock from the housing. Thus, an advantage may be that a lock used to secure an item may be secured to a selected location such that the removal of both the item and the lock is prevented and unauthorized tampering of the lock is prevented. Another advantage may be that the user may quickly engage or disengage the lock into or out of the housing such that securing their item is easy and fast.

In another aspect, a locking device for adding security to an item locked by a lock having a cable is provided, the locking device comprising: a housing configured to receive the lock by having a rectangular shape substantially similar to the lock, the housing comprising: an open top; a floor having a plurality of mounting holes, each one of the plurality of mounting holes configured for receiving a means for securing the housing to a surface; a first side wall having a first top wall end, and a plurality of openings; and a second side wall opposite of the first side wall; the first side wall and the second side wall extending perpendicularly from the floor; the plurality of openings being configured to receive a first cable end and a second cable end of the cable when the housing receives the lock by having: means for receiving the first cable end through the first top wall end into the housing and thus receiving the lock into the housing; means for restricting a movement of the first cable end out of the housing when means for unlocking and locking the second cable end into a first locking portion of the lock is engaged into a locked state; and a first circular opening inaccessible from the first top wall end and aligned with the first locking portion when the housing receives the lock.

Again, an advantage may be that a lock used to secure an item may be secured to a selected location such that the removal of both the item and the lock is prevented and unauthorized tampering of the lock is prevented. Again, another advantage may be that the user may quickly engage or disengage the lock into or out of the housing such that securing their item is easy and fast.

In another aspect, a method of securing an item locked by a lock having a cable is provided, wherein the cable has a first cable end associated with the lock at a first cable attachment point of the lock, and wherein the lock has means for unlocking and locking a second cable end at a first locking portion of the lock, using a locking device comprising: a housing configured to receive the lock by having a rectangular shape substantially similar to the lock, the housing comprising: an open top; a floor having a plurality of mounting holes, each one of the plurality of mounting holes configured for receiving a means for securing the housing to a surface; a first side wall having a first top wall end, and a plurality of openings; and a second side wall opposite of the first side wall; the first side wall and the second side wall extending perpendicularly from the floor; the plurality of openings being configured to receive the first cable end and the second cable end when the lock is received by the housing by having: a first L-shaped opening, wherein a vertical portion of the first L-shaped opening is a cutout on the first top wall end, and a horizontal portion of the first L-shaped opening, the horizontal portion being inaccessible from the first top wall end such that a vertical movement of the first cable end is restricted when the horizontal portion receives the first cable end; and a first circular opening inaccessible from the first top wall end, and aligned with the locking portion when the housing receives the lock; wherein the housing receives the lock by receiving the first cable end into the vertical portion of the first L-shaped opening and then further into the horizontal portion of the first L-shaped opening, such that the first cable attachment point is aligned with the horizontal portion and the lock rests on the floor, and thus restricts access to the plurality of mounting holes; and such that security to the item is added when the cable is threaded through the item and the second cable end is received by the first lock opening through the first circular opening and the second cable end is locked into the lock, thus preventing a removal of the lock from the housing; the method comprising the steps of: inserting a bolt of a plurality of bolts into each one of the plurality of mounting holes; securing the plurality of bolts to the surface; mounting the housing to the surface; disengaging the second cable end from the lock; inserting the first cable end into the vertical portion; sliding the first cable end into the horizontal portion; threading the second cable end of the cable through the item; inserting the second cable end into the first lock opening through the first circular opening; and engaging the lock to secure the second cable end into the lock. Again, an advantage may be that a lock used to secure an item may be secured to a selected location such that the removal of both the item and the lock is prevented and unauthorized tampering of the lock is prevented. Again, another advantage may be that the user may quickly engage or disengage the lock into or out of the housing such that securing their item is easy and fast.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
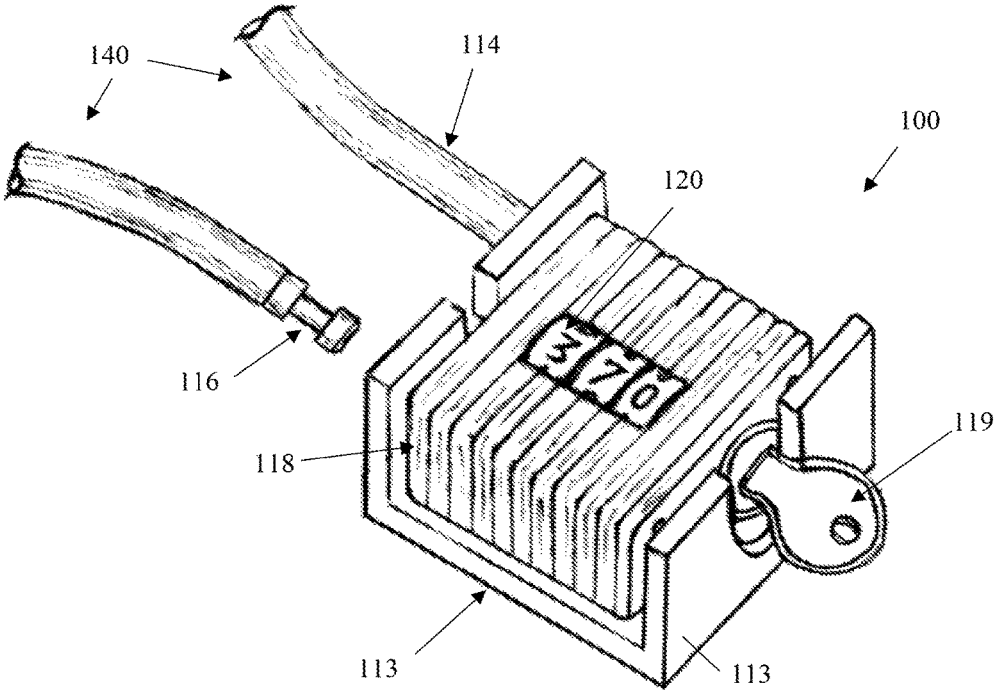
FIG. 1 illustrates a perspective view of a quick-release cable lock device, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 118 and 318, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates a perspective view of a quick-release cable lock device ("cable lock device," "cable lock apparatus," "cable locking apparatus," or "quick-release cable lock device") 113 for receiving and holding a lock having a cable, shown with a lock in an in-use state 100, according to an aspect. The cable lock device 100 may be a housing 113 that can be used with a lock having a cable 140, such as a combination or keyed padlock, as known in the art, for example, and may be used for adding security to the lock 118 or prevent removal of the lock 118 from a location. The cable lock device may thus receive a lock body ("cable lock body," "lock body," or "lock") 118 within the housing 113, which may then be secured to a surface, for example, for preventing unwanted removal of the lock from a location. The housing 113 may be constructed from steel, or any other suitable durable and tamper-proof materials. A cable loop ("cable loop" or "cable") may also be provided with the lock 118, of which a partial view 140 is shown, which may include two ends associated with the lock body 118 as shown by 114 and 116. An end 114 may be associated with the cable lock body 118 and a second end 116 of the cable loop 140 may be detachable and thus disengaged from the lock body 100 as shown as an example. The cable 140 may then be looped around or threaded into a portion of the item to be locked. The cable lock device 100 may be used with any lock 118 that has a detachable cable end, for example. As an example, the cable 140 may be looped directly into an opening of a firearm, or may securely close a lockbox or similar securing device within which a firearm or other valuable item is stored, by inserting a free end 116 into the item or lockbox and next inserting the end 116 into the lock body 118 and securing the lock. As an example, the lock 118 may be provided with either a keyed lock openable by a key 119 or a combination lock 120 in order to lock or unlock the cable end 116.

Figure 2:
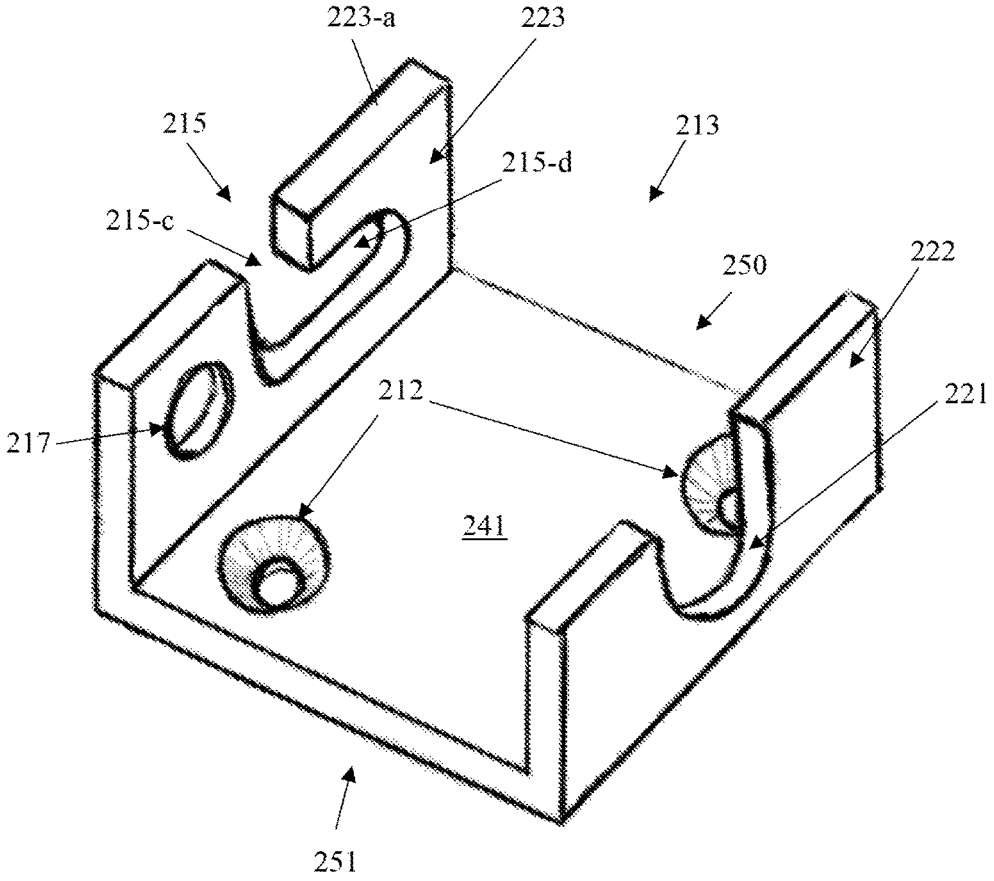
FIG. 2 illustrates the housing of the cable lock device, according to an aspect.

FIG. 2 illustrates the housing 213 of the cable lock device, according to an aspect. The housing 213 may include two side walls, which may be opposite each other. As an example, the side walls may be a left side wall 223 and a right side wall 222. The housing may be square or rectangular, and the two remaining sides may be open sides as indicated by 250 and 251, and may be opposite to each other, and may be provided such that the user can more easily insert a lock into the housing 213 or remove a lock (as shown by 118 in FIG. 1) from the housing 213. The top portion of the housing 213 may be open to provide access for the user to quickly access the lock, and also attach and detach the cable lock body (as shown by 118 in FIG. 1) into and out of the housing 213. The housing 213 may also include openings as shown by 217 and 215 in the left side wall 223, which may be shaped and positioned to enable the lock body to be quickly attached and detached into and out of the housing 213. As an example, an opening ("hook opening") 215 may be provided in the shape of a hook or L-shaped, and an opening ("circular opening") 217 may be provided in the shape of a circle. The right side wall 222 may include an access opening ("keyhole opening") 221, which may be U-shaped, and may be positioned and shaped to accommodate a key if the lock is key-activated. The base or floor of the housing 241 may include a plurality of mounting holes 212, provided for fastening the cable lock device to any given solid surface, such as lockers, dressers, or any other suitable surface, by using a plurality of screws, threaded bolts, or mounting bolts or strong adhesive tapes, for example. The housing 213 may be secured or mounted to a solid surface similarly to a bracket, for example. The housing and thus the cable lock device may then be securely associated with a solid surface which may help to prevent removal of the cable lock device.

The hook opening 215 of the housing may, again, be L-shaped, having a vertical portion 215-*c* and a horizontal portion 215-*d*. The vertical portion 215-*c* may be a cutout in the top side 223-*a* of the side wall 223. As an example, a lock (as shown by 118 in FIG. 1) having a cable end attached to it (as shown by 114 in FIG. 1) may be inserted into the housing 213 by slipping the lock at an angle and inserting the cable end 114 into the vertical portion 215-*c*, and straightening the lock such that the cable end 114 is within the horizontal portion 215-*d*. The lock may then be secured into place by inserted a second cable end 116 through the circular opening 217, which may not allow access through the top side 223-*a* of the side wall 223, and next the cable end 116 may be inserted into the lock and locked into place. Thus, the first cable end 114 may be prevented from removal through the vertical portion 215-*c* by not permitting further movement of the lock body.

Figure 3:
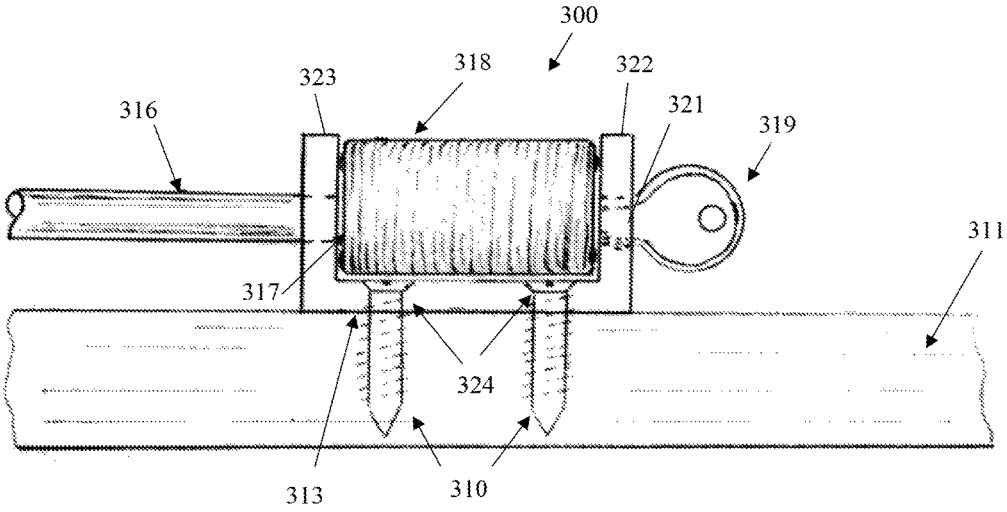
FIG. 3 illustrates the side sectional view of the cable lock device, bolted to a solid surface, according to an aspect.

FIG. 3 illustrates the side sectional view of the cable lock device 300, bolted to a solid surface 311, according to an aspect. A partial view of the one cable end 316 is shown. As shown, the cable lock body 318 may be secured into the housing 313, and locked between the two side walls 322 and 323. Screws 310 may be used to secure the device 300 into the solid surface 311 by inserting the screws 310 through the mounting holes (as shown by 212 in FIG. 2). The heads 324 of the screws or bolts 310 may be inaccessible to any unauthorized user due to the presence of the lock body 318, which may be restricted from movement by the locked cable ends. The housing 313 of the cable lock device 300 may thus be easily mounted to any suitable surface, and unauthorized removal may be prevented when the lock of the device is engaged. Thus, an advantage may be that the item being locked by the user may be provided with added security, and the user may easily choose where to lock their valuable items. An end 316 of the cable may be inserted into the housing 313 through the circular opening 317, and attached to the lock body 318. A key 319 may be inserted into the lock body 318 through the keyhole opening 321 to be turned to open the lock and disengage one or both cable ends.

Figure 4:
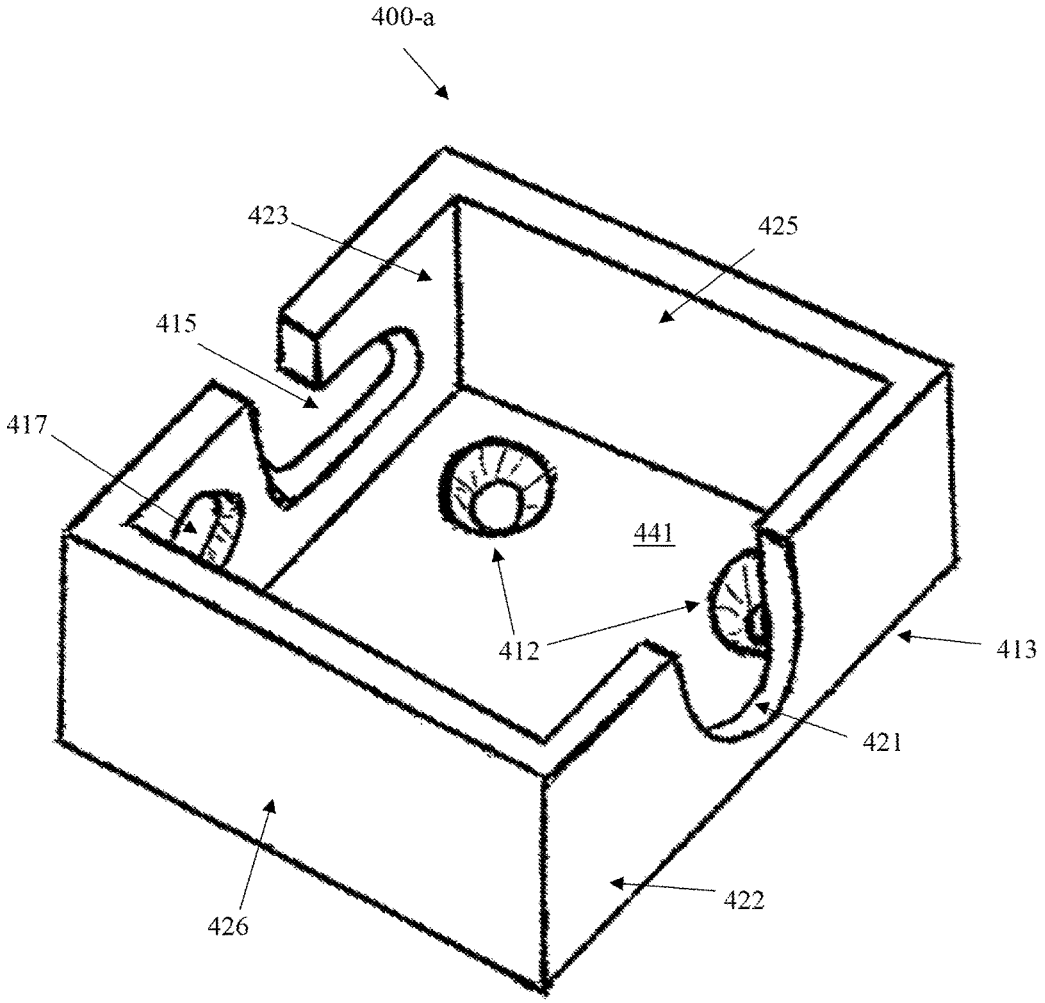
FIG. 4 illustrates another example of a cable lock device having a housing with four side walls, according to an aspect.

FIG. 4 illustrates another example of a cable lock device 400-*a* having a housing with four side walls 422, 423, 425, and 426 ("four-walled lock device"), according to an aspect. The openings on the left side wall 423 and the right side wall 422 may include the same arrangements and functions as illustrated in FIG. 2. The top portion of the housing 413 may be open to enable the lock body (as shown by 118 in FIG. 1) to be quickly inserted and attached to the cable ends by placing the lock body vertically into and out of the device. Again, the floor 441 of the four-walled lock device 400-*a* may include mounting holes 412 for insertion of screws, bolts, or other similar securing means. An advantage of a four-walled lock device 400-*a* may be that further movement of the lock body may be restricted and thus adding security to the item being locked by the user.

Figure 5:
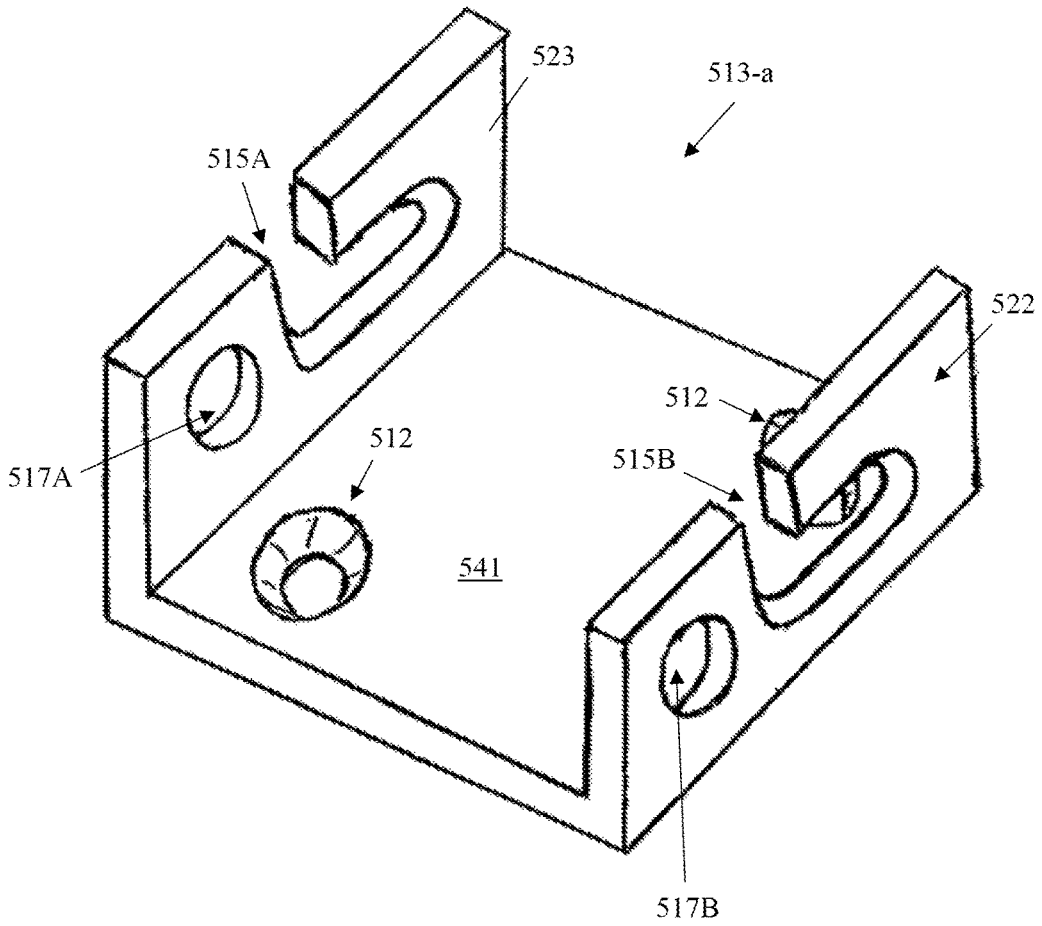
FIG. 5 illustrates another example of a cable lock device, having two side walls sharing the same set of openings, according to an aspect.
Figure 6:
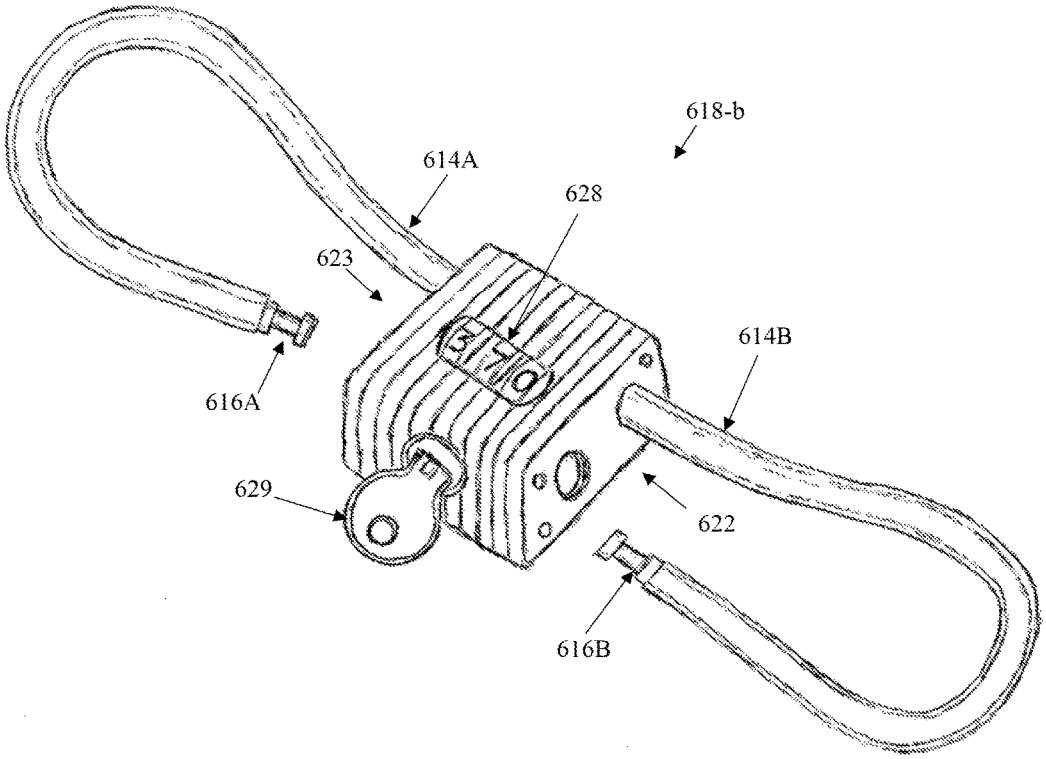
FIG. 6 illustrates a double-sided cable lock which may be used with a double-sided housing as shown in FIG. 5, according to an aspect.

FIG. 5 illustrates another example of a cable lock device ("double-sided lock device") 513-*a*, having two side walls sharing the same set of openings, according to an aspect. As an example, the housing ("double-sided housing") 513-*a* of the device may be double sided, such that its two side walls have similar or identical openings. As an example, the openings present on the two side walls, the left side wall 523 and the right side wall 522, may be the openings as shown and described when referring to FIG. 2, which may be a circular opening and a hook opening. Thus, the left side wall 523 may include one circular opening 517A and one hook opening 515A, and the right side wall 522 may include one circular opening 517B and one hook opening 515B, for example. An advantage may be that a double-sided cable lock (as shown in FIG. 6) may be inserted into the double-sided housing 513-*a*. Again, the floor 541 of the double-sided lock device 513-*a* may include mounting holes 512 for insertion of screws, bolts, or other similar securing means.

FIG. 6 illustrates a double-sided cable lock 618-*b* which may be used with a double-sided housing 513-*a* as shown in FIG. 5, according to an aspect. As an example, the double-sided cable lock 618-*b* may include one locking cable loop having ends that may be inserted and locked into two sides of the lock body. As an example, the lock body 618-*b* may have a left side 623 and a right side 622, both of which may receive and lock two ends of the cable. As an example, on the left side 623, cable ends 614A and 616A be associated, and on the right side 622, cable ends 614A and 616B may be associated. As an example, the lock 618-*b* may be engaged into a locked state and may be engaged into an unlocked state by using a combination lock dial 628, or by using a key 629. An advantage of the double-sided cable lock 618-*b* may be that security of the user's items may be increased by using two locking cables instead of one. Another advantage may be that multiple devices or items may be secured by the user using only a single cable lock device 618-*b*.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to.

Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the device or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A locking device for adding security to an item locked by a lock having a cable, wherein the cable has a first cable end associated with the lock at a first cable attachment point of the lock, and wherein the lock has means for unlocking and locking a second cable end at a first locking portion of the lock, the locking device comprising:

a housing configured to receive the lock by having a rectangular shape substantially similar to the lock, the housing comprising:

an open top;

a floor having a plurality of mounting holes, each one of the plurality of mounting holes configured for receiving a means for securing the housing to a surface;

a first side wall having a first top wall end, and a plurality of openings; and a second side wall opposite of the first side wall;

the first side wall and the second side wall extending perpendicularly from the floor;

the plurality of openings being configured to receive the first cable end and the second cable end when the lock is received by the housing by having:

a first L-shaped opening, wherein a vertical portion of the first L-shaped opening is a cutout on the first top wall end, and a horizontal portion of the first L-shaped opening, the horizontal portion being inaccessible from the first top wall end such that a vertical movement of the first cable end is restricted when the horizontal portion receives the first cable end; and a first circular opening inaccessible from the first top wall end, and aligned with the locking portion when the housing receives the lock;

wherein the housing receives the lock by receiving the first cable end into the vertical portion of the first L-shaped opening and then further into the horizontal portion of the first L-shaped opening, such that the first cable attachment point is aligned with the horizontal portion and the lock rests on the floor, and thus restricts access to the plurality of mounting holes; and such that security to the item is added when the cable is threaded through the item and the second cable end is received by the first lock opening through the first circular opening and the second cable end is locked into the lock, thus preventing a removal of the lock from the housing.

2. The locking device of claim 1, wherein the second side wall comprises a second circular opening identical to the first circular opening, and a second L-shaped opening identical to the first L-shaped opening.

3. The locking device of claim 1, wherein means for unlocking and locking a second cable end at a first locking portion of the lock is activated by a key and the second side wall comprises an opening providing access for the key to the lock.

4. The locking device of claim 1, further comprising a third side wall and a fourth side wall.

5. A locking device for adding security to an item locked by a lock having a cable, the locking device comprising:

a housing configured to receive the lock by having a rectangular shape substantially similar to the lock, the housing comprising:

an open top;

a floor having a plurality of mounting holes, each one of the plurality of mounting holes configured for receiving a means for securing the housing to a surface;

a first side wall having a first top wall end, and a plurality of openings; and a second side wall having a second top wall end, the second side wall being opposite of the first side wall;

the first side wall and the second side wall extending perpendicularly from the floor;

the plurality of openings being configured to receive a first cable end and a second cable end of the cable when the housing receives the lock by having:

means for receiving the first cable end through the first top wall end into the housing and thus receiving the lock into the housing;

means for restricting a movement of the first cable end out of the housing when means for unlocking and locking the second cable end into a first locking portion of the lock is engaged into a locked state;

means for receiving a third cable end through the second top wall end;

means for restricting a movement of the third cable end out of the housing when means for unlocking and locking a fourth cable end into a second locking portion of the lock is engaged into a locked state;

a first circular opening inaccessible from the first top wall end and aligned with the first locking portion when the housing receives the lock; and a second circular opening inaccessible from the second top wall end and aligned with the second locking portion when the housing receives the lock.

6. The locking device of claim 5, wherein the means for unlocking and locking the second cable end into a first locking portion of the lock is activated by a key and the second side wall comprises an opening providing access for the key to the lock.

7. The locking device of claim 5, further comprising a third side wall and a fourth side wall.

8. A method of securing an item locked by a lock having a cable, wherein the cable has a first cable end associated with the lock at a first cable attachment point of the lock, and wherein the lock has means for unlocking and locking a second cable end at a first locking portion of the lock, using a locking device comprising:

a housing configured to receive the lock by having a rectangular shape substantially similar to the lock, the housing comprising:

an open top;

a floor having a plurality of mounting holes, each one of the plurality of mounting holes configured for receiving a means for securing the housing to a surface;

a first side wall having a first top wall end, and a plurality of openings; and a second side wall opposite of the first side wall;

the first side wall and the second side wall extending perpendicularly from the floor;

the plurality of openings being configured to receive the first cable end and the second cable end when the lock is received by the housing by having:

a first L-shaped opening, wherein a vertical portion of the first L-shaped opening is a cutout on the first top wall end, and a horizontal portion of the first L-shaped opening, the horizontal portion being inaccessible from the first top wall end such that a vertical movement of the first cable end is restricted when the horizontal portion receives the first cable end; and a first circular opening inaccessible from the first top wall end, and aligned with the locking portion when the housing receives the lock;

wherein the housing receives the lock by receiving the first cable end into the vertical portion of the first L-shaped opening and then further into the horizontal portion of the first L-shaped opening, such that the first cable attachment point is aligned with the horizontal portion and the lock rests on the floor, and thus restricts access to the plurality of mounting holes; and such that security to the item is added when the cable is threaded through the item and the second cable end is received by the first lock opening through the first circular opening and the second cable end is locked into the lock, thus preventing a removal of the lock from the housing;

the method comprising the steps of:

inserting a bolt of a plurality of bolts into each one of the plurality of mounting holes;

securing the plurality of bolts to the surface;

mounting the housing to the surface;

disengaging the second cable end from the lock;

inserting the first cable end into the vertical portion;

sliding the first cable end into the horizontal portion;

threading the second cable end of the cable through the item;

inserting the second cable end into the first lock opening through the first circular opening; and engaging the lock to secure the second cable end into the lock.

9. The method of claim 8, wherein the second side wall comprises a second circular opening identical to the first circular opening, and a second L-shaped opening identical to the first L-shaped opening; and wherein:

the cable further comprises a third cable end and fourth cable end; and the lock is associated with the third cable end at a second cable attachment point on the lock; and the lock is further configured to receive the fourth cable end through a second lock opening on the lock.

10. The method of claim 9, further comprising the steps of:

disengaging the fourth cable end from the lock;

inserting the first cable end into a second L-shaped opening vertical portion;

sliding the first cable end into a second L-shaped opening horizontal portion;

threading the fourth cable end of the cable through the item or through a second item;

inserting the fourth cable end into the second lock opening through the second circular opening; and engaging the lock to secure the fourth cable end into the lock.

11. The method of claim 9, wherein the engaging the lock to secure the second cable end into the lock step is performed by actuating a key into the lock.

12. The method of claim 9, wherein the engaging the lock to secure the second cable end into the lock step is performed by actuating a combination dial on the lock.

13. The method of claim 9, wherein the locking device further comprises a third side wall and a fourth side wall.

* * * * *